United States Patent [19]

Franz et al.

[11] 4,357,850

[45] Nov. 9, 1982

[54] TONE GENERATOR SYSTEM FOR ELECTRONIC MUSICAL INSTRUMENTS

[76] Inventors: Reinhard Franz, Tulpenstrasse 15, D-5401 Emmelshausen; Wilfried Dittmar, Feldstrasse 18, D-5401 Halsenbach, both of Fed. Rep. of Germany

[21] Appl. No.: 226,694

[22] Filed: Jan. 21, 1981

[30] Foreign Application Priority Data

Jan. 22, 1980 [DE] Fed. Rep. of Germany ..... 3002095

[51] Int. Cl.[3] ..... G10H 1/02; G10H 5/07

[52] U.S. Cl. ..... 84/1.01; 84/1.24; 84/1.25; 84/445; 84/DIG. 4; 84/DIG. 11

[58] Field of Search ..... 84/1.01, 1.24, 1.25, 84/445, DIG. 4, DIG. 11

[56] References Cited

U.S. PATENT DOCUMENTS 3,828,109 8/1974 Morez ..... 84/1.01
3,910,149 10/1975 Obayashi ..... 84/1.01
4,117,759 10/1978 Kato ..... 84/1.01 X
4,242,935 1/1981 Peterson et al. ..... 84/1.01
4,262,575 4/1981 Bean ..... 84/1.24

*Primary Examiner*—Stanley J. Witkowski
*Attorney, Agent, or Firm*—Kontler, Grimes & Battersby

[57] ABSTRACT

A tone generator system for electronic musical instruments includes a voltage-regulated, high-frequency oscillator. The output of the oscillator is connected with the inputs of first and second 12-tone divider circuits having outputs for transmission of full octaves of tone signals. The connection between the output of the oscillator and the input of one of the divider circuits contains circuitry which intercepts each $n^{th}$ signal of the series of signals transmitted by the oscillator so that the one divider circuit is out of tune with the other divider circuit. The number n can be varied by a battery of switches and can be as low as 2 or higher than 128. An auxiliary signal dividing circuit can be connected between the output of the oscillator and the input of the other divider circuit.

13 Claims, 1 Drawing Figure

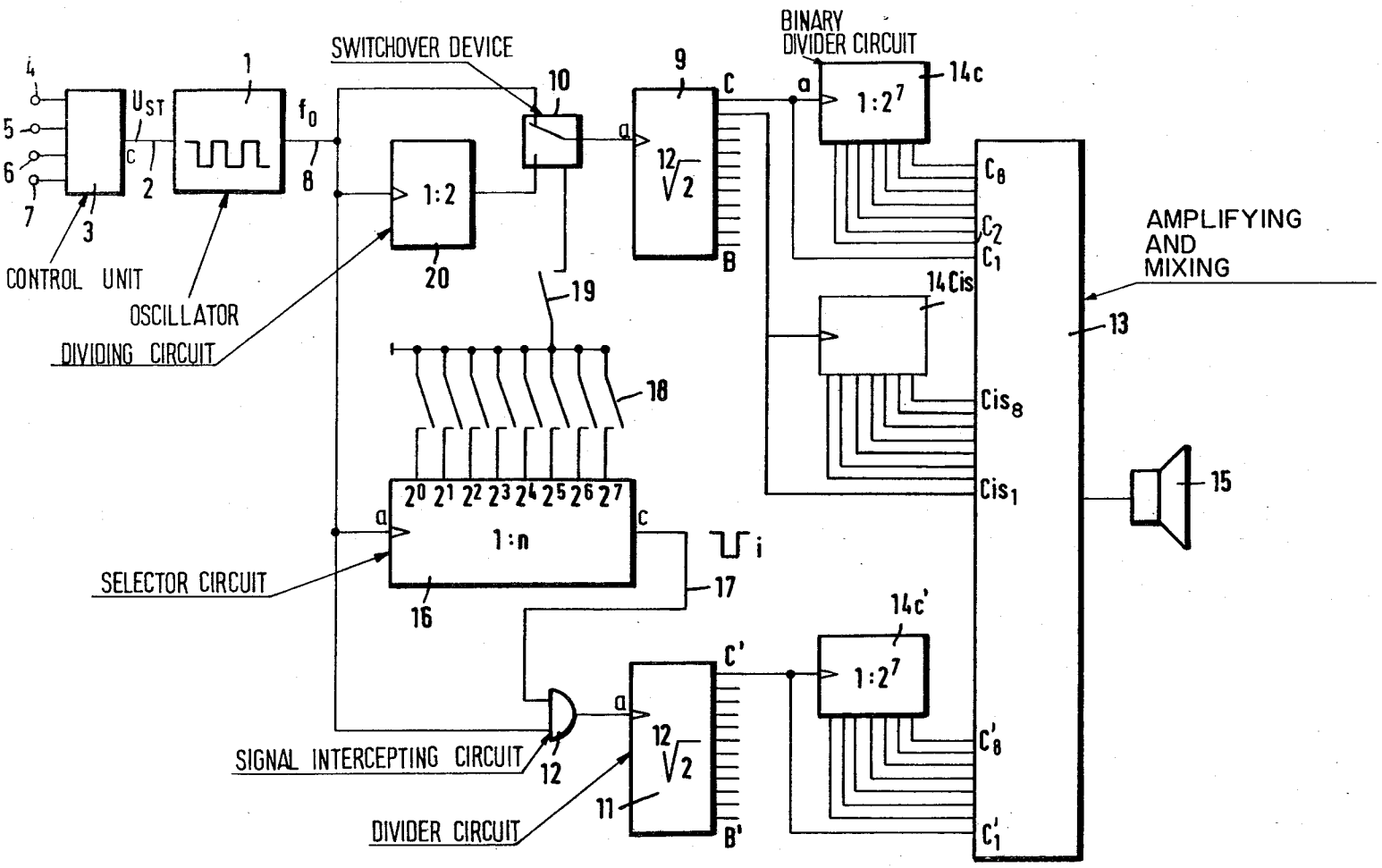
AMPLIFYING AND MIXING
13
15
BINARY DIVIDER CIRCUIT
14c
1:2^7
14Cis
14c'
1:2^7
9
12
√2
10
SWITCHOVER DEVICE
1:2
20
19
18
1:n
16
17
12
√2
11
SIGNAL INTERCEPTING CIRCUIT
DIVIDER CIRCUIT
SELECTOR CIRCUIT
1
OSCILLATOR
DIVIDING CIRCUIT
CONTROL UNIT
2
3
4
5
6
7
8

TONE GENERATOR SYSTEM FOR ELECTRONIC MUSICAL INSTRUMENTS

CROSS-REFERENCE TO RELATED APPLICATION

Certain components of the system which is described and claimed in the present application are disclosed in the commonly owned copending application Ser. No. 222,895 filed Jan. 6, 1981 by Reinhard FRANZ et al. now U.S. Pat. No. 4,332,182 for "Apparatus for transposing passages in electronic musical instruments."

BACKGROUND OF THE INVENTION

The present invention relates to electronic musical instruments in general, and more particularly to improvements in a tone generator system for use in electronic musical instruments of the type wherein a primary or main generator which constitutes a voltage-regulated oscillator is used for the generation of frequency signals, wherein such signals are transmitted to the loudspeaker through the medium of a first 12-tone divider circuit whose outputs transmit tone signals of a first octave, and wherein the loudspeaker also receives signals from at least one second 12-tone divider circuit whose outputs transmit tone signals of a second octave. The signals of the second octave are out of tune with the signals of the first octave.

A presently known system of the just outlined character utilizes two primary generators each of which constitutes a voltage-regulated oscillator and each of which transmits high-frequency signals to a discrete 12-tone divider circuit. By dividing the high frequency signals (e.g., 2 MHz) with a divisor which is a whole multiple of one, it is possible to obtain at the outputs of the divider circuits tone signals having an average frequency of 6 kHz. Thus, and referring to the highest tone of the octave, each divider circuit has an internal dividing ratio of $\sqrt[12]{2}$. Each tone system rigidly follows the frequency of the corresponding primary generator.

The two primary generators are slightly out of tune to thus accomplish a certain amount of interference or beating of the tone. Such effect is especially interesting when the musical instrument is to generate tones in imitation of a piano wherein the generation of tones takes place by resorting to two or more strings which are slightly out of tune. In order to achieve such slight interference effects, the regulating voltages for the two primary generators must deviate, at least very slightly, from one another. However, even if one employs voltage-regulated oscillators which are designed to furnish high-constancy frequency signals, the difference between the frequencies of signals which are furnished by two discrete primary generators is bound to change with time. Therefore, it is necessary to resort to complex and expensive tuning systems which are intended to correct such errors, i.e., to correct deviations of the difference between the two high-frequency signals from a desired value.

OBJECTS AND SUMMARY OF THE INVENTION

An object of the invention is to provide a novel and improved tone generator system which is simpler than but at least as versatile as presently known tone generator systems for electronic musical instruments.

Another object of the invention is to provide a system which utilizes a single high-frequency oscillator circuit.

A further object of the invention is to provide a novel and improved connection between a single high-frequency oscillator circuit and a plurality of 12-tone divider circuits.

An additional object of the invention is to provide the above outlined tone generator system with simple and versatile means for changing the sound effects.

Still another object of the invention is to provide a tone generator system wherein the extent to which the signals furnished by two or more 12-tone divider circuits are out of tune remains unchanged regardless of the nature of control signals which are applied to the input means of the primary generator means.

A further object of the invention is to provide a tone generator system which can be installed in existing electronic musical instruments as a superior substitute for heretofore known systems.

Another object of the invention is to provide an electronic musical instrument which embodies a tone generator system of the above outlined character.

A further object of the invention is to provide a tone generator system whose manipulation is no more complex than the manipulation of heretofore known systems and which can be readily converted to produce any one of a large number of different effects including transposition, vibrato and many others.

The invention is embodied in a tone generator system for electronic musical instruments which comprises a primary generator (preferably a voltage-regulated high-frequency oscillator whose output transmits a series of signals at a given frequency, such frequency being variable by a control circuit which is connected with the input of the oscillator), a plurality of 12-tone divider circuits each having a signal receiving input and outputs arranged to transmit full octaves of tone signals, means for connecting the output of the primary generator with the input of one of the 12-tone divider circuits, and means for transmitting some signals of the aforementioned series of signals from the output of the primary generator to the input of another 12-tone divider circuit so that the one and the other divider circuit are out of tune to a desired extent.

The transmitting means includes intercepting means (e.g., a logic circuit having a first input connected with the output of the primary generator, a second input and an output connected with the input of the other divider circuit) which is activable to intercept certain signals of the series of signals, and selector means (e.g., an 8-bit dividing circuit) which is operable to actuate the intercepting means. The selector means has an input connected with the output of the primary generator and an output connected with the second input of the logic circuit. The selector means can be designed to be operated in response to reception of each $n^{th}$ signal of the series of signals wherein n is a whole number exceeding 128 and/or wherein n is a whole number between 2 and 4.

The tone generator system may further comprise an auxiliary signal dividing circuit and switchover means which is operable to connect the auxiliary circuit between the output of the primary generator and the input of the one 12-tone divider circuit.

If the selector means is adjustable, the adjusting means may comprise a battery of switches one or more of which can be opened or closed to thereby change that number of the series of signals which is transmitted to the input of the other divider circuit. The arrangement is such that the aforementioned number n varies in dependence upon selection of the number and grouping of opened or closed switches.

The novel features which are considered as characteristic of the invention are set forth in particular in the appended claims. The improved tone generator system itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a circuit diagram of a tone generator system which embodies one form of the invention and is provided with a single primary generator and two 12-tone divider circuits.

DESCRIPTION OF THE PREFERRED EMBODIMENTS

The drawing shows a main or primary generator 1 which constitutes a voltage-regulated high-frequency oscillator and has an input 2 receiving regulating signals $U_{st}$ from the output c of a control unit 3. The latter has several inputs 4, 5, 6 and 7 for reception of signals which can modify the regulating signal $U_{st}$ so as to achieve various special effects or transposition which can alter the entire tenor of the tone generator system. The output 8 of the primary generator 1 transmits a high-frequency signal $f_o$, e.g., in the range of 2 MHz. The signal $f_o$ is applied to the input a of a first 12-tone divider circuit 9 through the medium of an electronic switchover device 10 as well as to the input a of a second 12-tone divider circuit 11 through the medium of a pulse removing or intercepting circuit 12 which can constitute an inhibitor or an AND gate. The outputs B–C and B′–C′ of the divider circuits 9 and 11 transmit tone frequency signals of complete octaves. On the average, the frequency of each such signal is in the range of 6 kHz.

The output C of the divider circuit 9 is directly connected with the tone signal input C1 of the amplifying and/or mixing component 13 of the electronic musical instrument as well as with the input a of a binary divider circuit or counter 14c whose outputs are connected with further inputs C2–C8 of the component 13. Thus, the tone signal appearing at the output C of the circuit 9 is available in eight different octaves. In a similar fashion, the other outputs of the divider circuit 9 are connected with the component 13 of the musical instrument by additional binary divider circuits 14Cis, etc. Those inputs of the component 13 of the musical instrument which are connected with the corresponding outputs of the divider circuit 14Cis are shown at Cis1 to Cis8, and so forth. Additional (non-illustrated) binary divider circuits are connected with the third, fourth, etc. outputs of the 12-tone divider circuit 9.

Analogously, each of the outputs C′–B′ of the 12-tone divider circuit 11 is connected directly with an input of the component 13 (see the connection between the output C′ and input $C_1'$ in the lower right-hand portion of the drawing) as well as indirectly through the corresponding binary divider circuits (only the circuit 14c′ is shown in the drawing). The reference character $C_8'$ denotes one of those inputs of the component 13 which are connected with the 12-tone divider circuit 11 through the medium of the divider circuit 14c′.

The output of the component 13 can transmit tone signals to a loudspeaker 15, namely, a total of eight octaves for each of the two tone systems presented by the 12-tone divider circuits 9 and 11.

The high-frequency signal $f_o$ which appears at the output 8 of the primary generator 1 is further transmitted to the input a of a programmable selector circuit 16 whose output c transmits a signal i in response to the application of n successive signals to its input a. In other words, the circuit 16 applies a signal i to the corresponding input of the pulse intercepting circuit 12 via conductor 17 after the other input of the circuit 12 receives n successive signals $f_o$ from the output 8 of the primary generator 1. This means that, when compared with the number of signals transmitted to the circuit 9, the number of signals applied to the input a of the 12-tone divider circuit 11 is reduced by a predetermined number per unit of time. In other words, when the circuit 16 transmits a signal i, the circuit 12 prevents the transmission of a signal from the output 8 of the primary generator 1 to the input a of the 12-tone divider circuit 11. Otherwise stated, the operating frequency of the circuit 11 is less than the operating frequency of the circuit 9, and the ratio of the two operating frequencies is determined by programming of the selector circuit 16. The latter is equipped with a battery of programming switches 18 each of which can transmit signals to and thereby activate one of an equal number of inputs $2^0$ to $2^7$ of the circuit 16. The binary sum of the values of the activated inputs ($2^0$ to $2^7$) totals n minus 1. If all of the switches 18 are closed, the circuit 12 prevents the transmission of each 256th signal to the input a of the circuit 11. Thus, the extent to which the divider circuit 11 is out of tune with the divider circuit 9 is 0.39 percent. If only the input $2^0$ of the circuit 16 is activated, the circuit 12 intercepts each second signal from the output 8 of the generator 1 so that the ratio of signals which are applied to the inputs a of the circuits 9 and 11 is two to one, i.e., the two circuits are out of tune by one full octave. If only the input $2^1$ is activated, the circuit 12 intercepts each third signal from the output 8 of the generator 1; this amounts to a shift by an interval of a fourth. If the inputs $2^0$ and $2^1$ are activated simultaneously, the circuit 12 intercepts each fourth signal $f_o$ which amounts to a shift by an interval of a fifth. It is clear that one can also achieve any desired intermediate value to thus produce special beat effects.

The electronic switchover device 10 is activable by a control switch 19 to transmit the high-frequency signal $f_o$ by way of a 1:2 auxiliary dividing circuit 20 to the input a of the circuit 9. In this manner, the tones which are produced in response to signals from the circuit 9 are one octave lower than the tones produced in response to signals from the circuit 11.

In each instance, the two tone systems are rigidly connected to each other by the high frequency ($f_o$) of the primary generator 1. If such frequency is varied by changing the regulating voltage signals $U_{ST}$, the relationship between the two circuits 9 and 11 remains unchanged even though the nature of the signals which are transmitted by the outputs B–C and B′–C′ of the circuits 9 and 11 changes.

It is further within the purview of the invention to provide additional 12-tone divider circuits whose inputs receive the signal $f_o$ at a selected frequency, i.e., to provide additional pulse intercepting circuits (such as inhibitors or AND gates) between the output 8 of the primary generator 1 and each such additional 12-tone divider circuit. This is advisable if the musical instrument including the component 13 is to imitate the sound effects of a piano wherein each tone is produced by three strings which are slightly out of tune with each other.

In accordance with one of the presently preferred embodiments of the invention, the following commercially available integrated circuits were used for assembling the system which is shown in the drawing: The parts 9 and 11 constituted integrated circuits known by the order number 82 and produced by SGS (Italy); the binary divider circuit 14c was a part known as CD 4024 B and produced by RCA or National Semiconductor; the programmable selector circuit 16 was a part sold by RCA or National Semiconductor under the order number 2x CD 4526 B; and the auxiliary dividing circuit 20 was a component sold by RCA or National Semiconductor under the order number 20 CD 4013.

An important advantage of the improved tone generator system is that a single primary generator 1 suffices to furnish signals to a plurality of 12-tone divider circuits. A discrete intercepting circuit (12) is provided for each 12-tone divider circuit in excess of one, and a discrete programmable selector circuit 16 is preferably provided for each intercepting circuit. This ensures that the tonal relationship between the signals furnished by the outputs of two or more 12-tone divider circuits remains unchanged regardless of the nature and/or intensity of the signal $U_{ST}$ which is applied to the input 2 of the primary generator 1. Each selector circuit 16 can determine, with any desired degree of accuracy, the number and/or sequence of signals which are not applied to the input of the corresponding (second, third, etc.) 12-tone divider circuit. In other words, the frequencies of the second, third, etc. 12-tone divider circuits deviate from the frequency of the first divider circuit 9 by predetermined values which can be readily adjusted if one resorts to adjustable selector circuits such as the illustrated circuit 16. Since the circuit 16 cooperates with the intercepting circuit 12 to prevent the transmission of certain high-frequency signals $f_o$ to the circuit 11, and the frequency of such signals is thereupon reduced by the circuit 11, the listener can detect only the different frequencies but not the relatively small distortion of the tone frequency signal. The two frequency ranges which are out of tune are rigidly coupled to each other. Therefore, it is readily possible to achieve special effects (such as hawaiian, slalom, vibrato, etc.) by the simple expedient of transmitting different regulating signals via input 4, 5, 6, or 7 of the control unit 3 for the primary generator 1. By the same token, one can achieve a transposition into other keys. This is not possible in conventional systems which utilize a discrete high-frequency oscillator for each 12-tone divider circuit because each and every change of control voltage which is applied to one of several oscillators changes the extent to which the two 12-tone divider circuits in a conventional system are out of tune.

Another important advantage of the improved tone generator system is its relatively low cost since such system requires a single high-frequency oscillator with attendant simplification of appurtenant circuitry.

At this time, we prefer to employ a selector circuit 16 with an adjustability factor of 1/n wherein n is a whole number exceeding 128. If the circuit 16 cooperates with the intercepting circuit 12 to prevent the transmission of each $128^{th}$ signal $f_o$ to the input a of the 12-tone divider circuit 11, the two sections of the system are out of tune by 0.78 percent. This value is reduced still further if the value of n is higher. Thus, it is possible to achieve extremely small differences between the two frequencies and hence very slight beating or interference effects.

It is also within the purview of the invention to select the circuit 16 in such a way that n is a whole number which is between 2 and 4. The second 12-tone divider circuit 11 is then capable of furnishing a series of output signals which are quite different from the signals at the outputs of the first 12-tone divider circuit 9. As explained above, the difference may amount to an interval of a fourth or a fifth or to a full octave.

In accordance with a presently preferred embodiment, the selector circuit 16 is an 8-bit dividing circuit because this allows for accomplishment of both aforesaid effects, i.e., minute and quite pronounced differences between the signals at the outputs of the 12-tone divider circuits 9 and 11. Still further (more pronounced) values of n can be achieved by resorting to the circuit 20 which is connectable in series with the circuit 16. In other words, the provision of the circuit 20 renders it possible to achieve even slighter interference effects.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A tone generator system for electronic musical instruments comprising:

(a) a plurality of dividing circuits arranged to transmit tone signals;

(b) a generator for generating signals at a predetermined frequency;

(c) first coupling means coupling said generator to one of said dividing circuits, said first coupling means including an auxiliary divider, and a switch for selectively coupling said generator to said one dividing circuit via a path through said auxiliary divider and a path which is clear of said auxiliary divider between said generator and said one dividing circuit; and (d) second coupling means coupling said generator to another of said dividing circuits, said second coupling means including a signal intercepting circuit, and an adjustable selector circuit operative to cause interception of a signal by said intercepting circuit in response to receipt of a predetermined number of signals from said generator.

2. The tone generator system of claim 1, wherein said dividing circuits are 12-tone dividing circuits arranged to transmit full octaves of tone signals.

3. The tone generator system of claim 1, wherein said auxiliary divider comprises a 1:2 dividing circuit.

4. The tone generator system of claim 1, wherein said generator is a primary, high frequency generator.

5. The tone generator system of claim 1, wherein said selector circuit comprises a 1/n dividing circuit which is adjustable such that n is variable from values in excess of 128 to values ranging from 2 to 4.

6. The tone generator system of claim 5, wherein n is a whole number.

7. The tone generator system of claim 1, comprising a battery of switches for adjusting said selector circuit.

8. The tone generator system of claim 1, wherein said selector circuit has an input connected with the output of said generator and an output connected with said intercepting circuit.

9. The tone generator system of claim 1, wherein said selector circuit is constructed and assembled to be operated in response to reception of each $n^{th}$ signal, n being a whole number in excess of 128.

10. The tone generator system of claim 1, wherein said selector circuit is constructed and assembled to be operated in response to reception of each $n^{th}$ signal, n being a whole number between 2 and 4.

11. The tone generator system of claim 1, wherein said selector circuit is an 8-bit dividing circuit.

12. The tone generator system of claim 7, wherein said intercepting circuit comprises a logic circuit, said selector circuit being adjustable by said switches for each $n^{th}$ signal, n being a whole number which is selected by said switches.

13. The tone generator system of claim 1, wherein said generator is a voltage-regulated, high-frequency oscillator; and further comprising means for varying the frequency of the signals at the output of said oscillator.

* * * * *